US005670221A

United States Patent [19]

Bried et al.

[11] Patent Number: 5,670,221

[45] Date of Patent: Sep. 23, 1997

[54] UNIVERSAL SOCKET FOR A FINIAL AND FINIAL INCORPORATING SUCH A SOCKET

[75] Inventors: David K. Bried, Loves Park; James Daniels, Freeport, both of Ill.

[73] Assignee: Newell Operating Company, Freeport, Ill.

[21] Appl. No.: 414,305

[22] Filed: Mar. 31, 1995

[51] Int. Cl.[6] ..... B44F 11/00

[52] U.S. Cl. ..... 428/28; 52/655.2; 160/314

[58] Field of Search ..... 52/655.1, 655.2; 160/314; 428/28; 362/123

[56] References Cited

U.S. PATENT DOCUMENTS

| | | | |
|---|---|---|---|
| 343,332 | 6/1886 | Munson | 428/28 |
| 696,534 | 4/1902 | Assel | 428/28 |
| 3,214,579 | 10/1965 | Pacini | 362/123 X |
| 3,643,288 | 2/1972 | Olivari | 428/28 X |

FOREIGN PATENT DOCUMENTS

| | | | |
|---|---|---|---|
| 3406550 | 9/1985 | Germany | 52/655.2 |

OTHER PUBLICATIONS

Packaging for decorative finials available from Springs Window Fashions Division, Inc. of Middleton, WI.

Packaging for decorative finials available from Kenny Mfg. Co. of Warwick, RI.

Advertising flier from the American Institute for Research & Development.

Installation instructions fro traverse rods and finials available from Acrimo Italia, s.r.l.

Installation instructions for Newell Window Furnishings.

Installation instructions for The Kirsch Company of Sturgis, MI.

*Primary Examiner*—Henry F. Epstein
*Attorney, Agent, or Firm*—Foley & Lardner

[57] ABSTRACT

A socket for mounting a finial on either of two telescoping tubular support rods includes a first engagement surface that enters into and contacts the smaller rod and a second engagement surface that surrounds and contacts the larger rod. The engagement surfaces wedge into an interference or force fit with the rod ends to maintain the finial on the rods. The surfaces are preferably defined by the side walls of an annular groove shaped to conform to the cross section of the support rod. The socket includes slots for mounting the finial on a holdback bracket. The slots are conveniently formed as widened regions of the annular groove and are positioned in diametrically opposed locations to permit top-to-bottom symmetrical finials to be inverted about a horizontal axis and front-to-back symmetrical finials to be inverted about a vertical axis for mounting on the left or the right side of a window opening.

13 Claims, 3 Drawing Sheets

UNIVERSAL SOCKET FOR A FINIAL AND FINIAL INCORPORATING SUCH A SOCKET

BACKGROUND OF THE INVENTION

1. Field of the Invention

The present invention relates generally to a novel socket structure for mounting a decorative finial to a rod or bracket, such as a curtain rod or curtain holdback support. More particularly, the invention relates to a mounting socket having an annular groove with tapered side walls for engaging such brackets and hollow rods of at least two different diameters, such as are commonly encountered for telescoping curtain rods.

2. Description of Related Art

Decorative finials have become popular accessory items for window coverings such as curtains, drapes and the like. Generally, such finials are fitted to the ends of the upper support rod of the window covering and may also be used to add a decorative touch to curtain holdbacks. Although the same or similar style finials are typically used for both ends of a support rod assembly and for holdbacks, problems associated with mounting such finials to rod assemblies and to holdback brackets have led to the development of a wide variety of finial mounting structures.

Support rod assemblies generally include a pair of hollow telescoping tubes or rods assembled to provide a upper bar of variable length. While commonly available telescoping curtain rods may have either a circular or an irregular cross section, each rod in the pair is similar in shape and one of the rods is formed with outer dimensions slightly smaller than the inner dimensions of the other rod, such that the first, or inner rod can slide within the second, or outer rod. Moreover, the outer extremities of most commonly available telescoping curtain rods are typically either bent at a right angle from the axis of the rod or simply terminate in an open end. In the former case the rods are mounted over a windowframe on brackets that fit within the bent rod end and no finials are used. In the latter case, the rods are generally mounted on brackets inset from the rod ends and the ends are covered by a decorative finial.

Curtain rod finials may be mounted on telescoping rods in a number of ways. For example, it is common to simply crimp an attachment portion of the finial to the curtain rod during factory assembly. This technique has the advantages of providing a secure mounting for the finial dispite the difference in sizes of the two telescoping rods. However, there are several disadvantages associated with rigidly matching finials to rods. Firstly, this technique generally requires the manufacturer to package and sell the completed rods as sets, rather than as separate rod and finial components. Retailers are, in turn, required to stock these complete sets of rods and finials. Ultimately, consumers are required to puchase the rods and finials together and may not select among a variety of finials to match rods of various color or style. Moreover, when a consumer desires to change the finial style, another complete set of rods must be purchased. In addition, preassembled holdbacks having matching finials must be purchased each time the rods are changed.

Recognizing the need for greater flexibility in matching various finials to various standard rods, other finial mounting techniques have been proposed. In one such technique, the finial includes a decorative portion and a mounting socket extending from the decorative portion for attachment to a cylindrical telescoping rod. The mounting socket includes an annular flange, the inner diameter of which is slightly smaller than the outer diameter of the smaller telescoping rod. Alignment tabs extend within the flange and enter the hollow cavity within the rod during mounting, while the annular flange fits snugly around the rod end. The dimensional relationship between the outer diameter of the smaller rod and the inner diameter of the flange ensures a slight interference fit between the finial socket and the smaller rod, and a similar, albeit much tighter fit between the socket and the larger rod. However, because the rods used with finials of this type are easily deformable, the larger rod may be forced into the socket without damage.

While finial mounting arrangements of this type may be satisfactory in certain applications, they are not without drawbacks. For example, because the single-sized annular flange relies on deformation of the rod ends, particularly in the case of the larger rod, this technique is unsatisfactory for attaching finials to relatively rigid rods or to smaller rods that are inherently more resistent to deformation by radial forces. Moreover, finials of this type are suitably configured for use with conventional holdback mounting brackets.

A need therefore exists for a mounting arrangement for decorative window covering finials that permits the finials to be securely mounted on the ends of telescoping support rods of different dimensions without requiring deformation of the support rods. In particular, it would be advantageous to provide a universal mounting structure, allowing the same finial to be used on holdback mounting brackets as well as on the ends of support rods.

SUMMARY OF THE INVENTION

The present invention features a novel and innovative finial socket suitable for supporting a finial on an end of either the larger or the smaller of two telescoping support rods or rails of a window covering. The socket may be configured for rods of different shapes and sizes and, advantageously, may include an arrangement for mounting the same finial on a holdback bracket, thus eliminating the need for separate and distinct finials for the rod and holdback. The invention also features a finial incorporating such sockets.

Thus, in accordance with one aspect of the invention, a socket is provided for mounting a finial to first or second tubular structures, the first tubular structure having peripheral dimensions smaller than the peripheral dimensions of the second tubular structure. The socket includes a first engagement surface configured to enter into the first tubular structure and a second engagement surface configured to at least partial surround the second tubular structure. The first engagement surface contacts at least a portion of the first tubular structure to retain the socket on the first tubular structure. The second engagement surface contacts the second tubular structure to retain the socket on the second tubular structure.

In accordance with another aspect of the invention, a finial is provided that is particularly adapted for mounting on a window covering support rod of the type including a first tube and a second tube, the first tube being slidably received in the second tube. The finial includes an end portion and a socket portion. The end portion covers an end of the first or the second tube and may include decorative features. The socket portion is coupled to the end portion for supporting the finial on the first or the second tube. The socket portion includes a first engagement surface configured to enter into the first tube and to contact at least a portion of the first tube to retain the socket on the first tube. The socket portion also includes a second engagement surface configured to at least partially surround the second tube and to contact the second tube to retain the socket on the second tube.

In accordance with a further aspect of the invention, a finial is provided that is adapted for mounting on a tubular window covering support rod of the type including a first tube slidingly received in a second tube and on a holdback bracket of the type having a holdback portion terminating in a finial mounting portion. The finial includes a decorative portion and a socket portion. The socket portion is coupled to the decorative portion for maintaining the finial on the rod or the bracket. The socket portion including a first engagement surface configured to enter into and engage the first tube, a second engagement surface configured to fit over and engage the second tube and a slot configured to receive the mounting portion of the holdback bracket.

BRIEF DESCRIPTION OF THE DRAWINGS

The present invention will become more fully understood from the following detailed description, taken in conjunction with the accompanying drawings, wherein like reference numerals refer to like parts, in which.

DESCRIPTION OF THE PREFERRED EMBODIMENTS

Before beginning the detailed description of the FIGURES and the preferred embodiments shown therein, several general comments will assist in understanding the scope of the invention. First, the most preferred and illustrated embodiments of the socket and finials discussed below are adapted to secure a finial on a generally circular cylindrical tubular rod and on a holdback bracket having an arcuate mounting portion. However, the present invention is not intended to be limited to this circular configuration, but is intended to encompass sockets and finials adapted for securing on other rod and bracket shapes as well. For example, the structure discussed below may be adapted to secure a finial on cylindrical, square cross-section rods as well as on rods and brackets having irregular or oblong shapes. Moreover, such rods have a closed cross section, as with extruded or welded-seam rods, or may have an open cross-section, as is typical of rolled metal rods.

Figure 1:
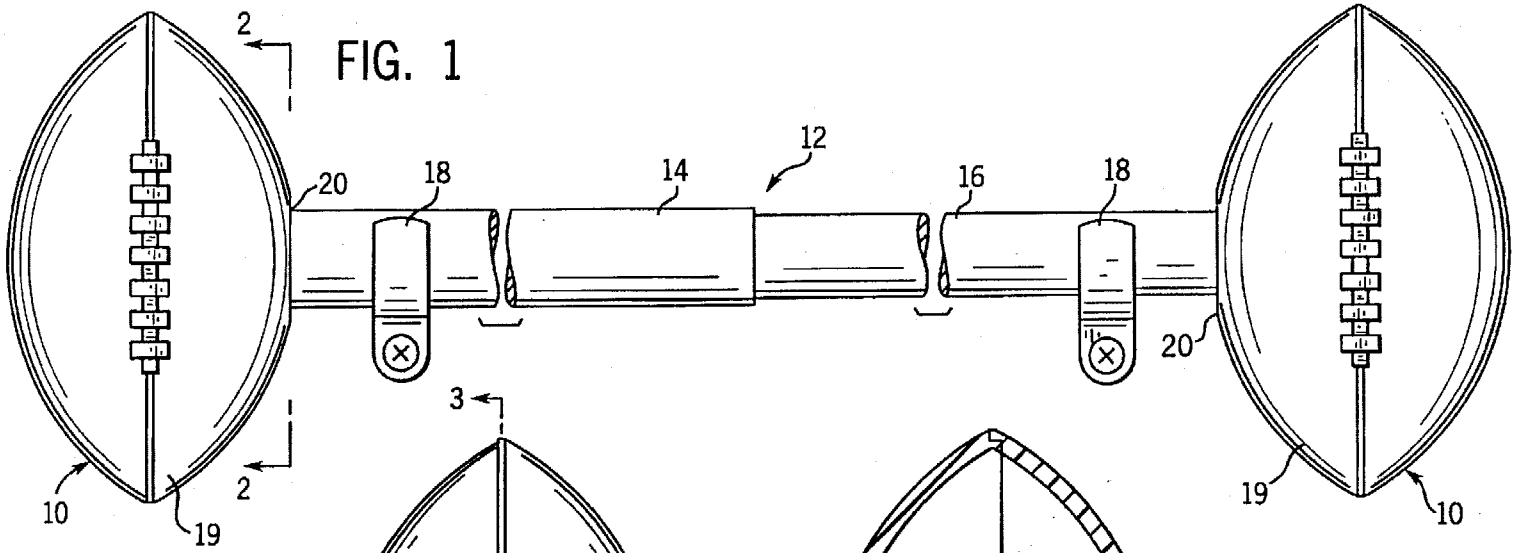
FIG. 1 is a plan view of a pair of finials in accordance with an exemplary embodiment of the invention mounted on the ends of tubular support rods of a window covering.

Turning now to the drawings and referring first to FIG. 1, a pair of exemplary finials 10 are illustrated as they would be installed on the ends of a rod 12 such as for a window covering. In the embodiment shown in FIG. 1, rod 12 is a telescoping support rod comprising a large tube 14 and a smaller tube 16 received within large tube 14. As is well known in the art, tubes 14 and 16 are similar in cross sectional shape, such as circular cylindrical, and tube 14 has internal dimensions slightly greater than the external dimensions of tube 16, such that tube 16 is free to slide within tube 14. Tubes 14 and 16 may be open cross section, rolled tubular structues or may have a closed cross section. For installation, tubes 14 and 16 are assembled telescopingly and a window covering, such as a curtain (not shown) is placed on the rod. Tubes 14 and 16 are then slid with respect to one another to obtain the desired length of rod 12 and rod 12 is placed on suitable brackets 18 fastened to a wall or window frame. Finials 10 are then installed on the ends of tubes 14 and 16 as described below.

Figure 2:
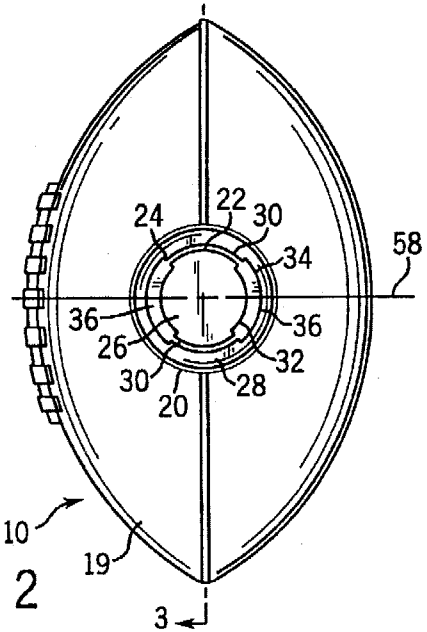
FIG. 2 is a side view of one of the finials illustrated in FIG. 1, showing a preferred embodiment of a finial mounting socket in accordance with the invention.
Figure 3:
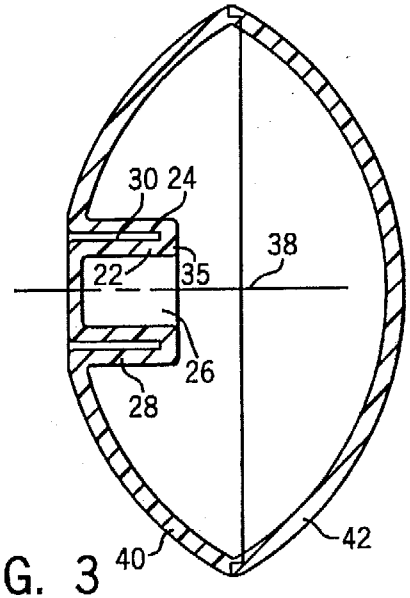
FIG. 3 is a is a sectional view of the finial of FIG. 2 along section 3—3, illustrating the preferred configuration of the socket.
Figure 7:
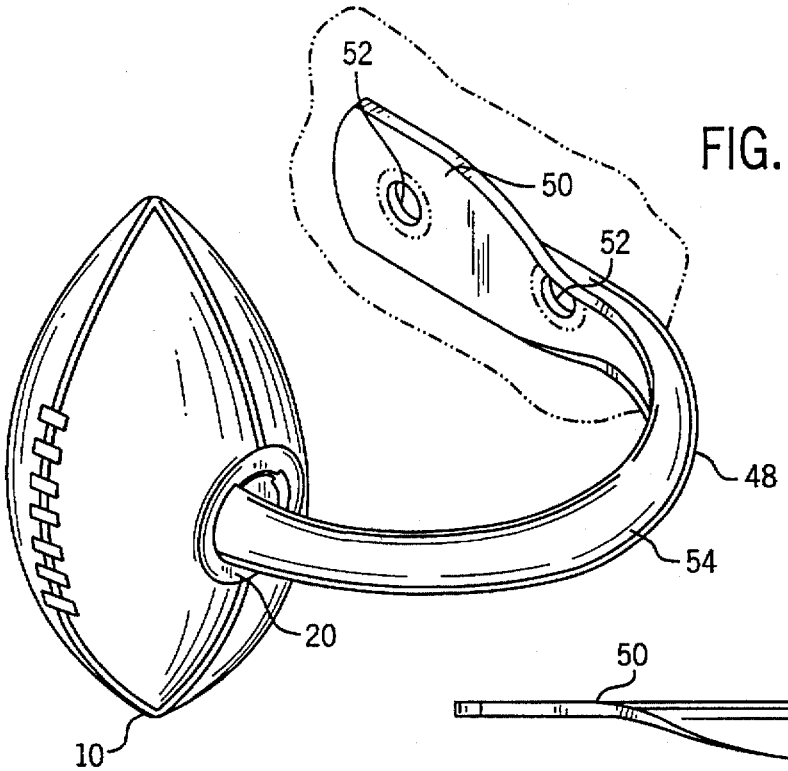
FIG. 7 is a perspective view of a holdback bracket supporting the finial of FIG. 1.
Figure 8:
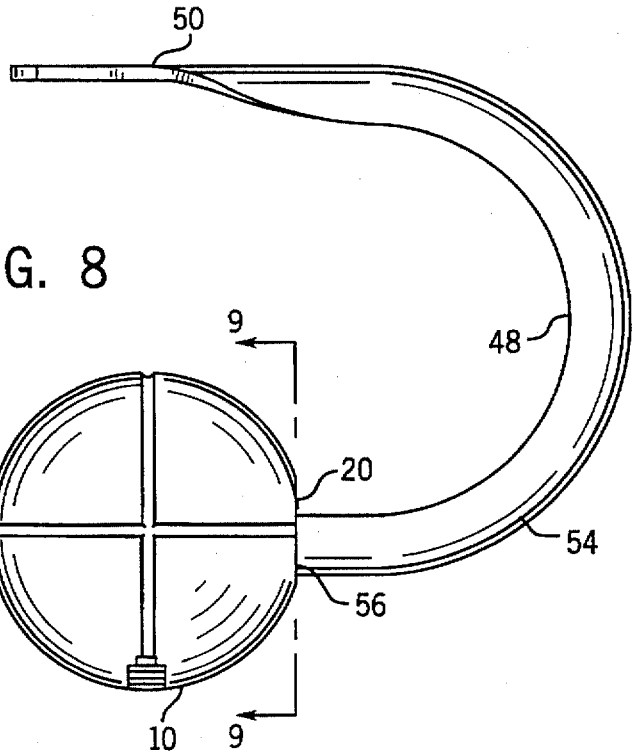
FIG. 8 is a top plan view of the finial and holdback bracket shown in FIG. 7.
Figure 9:
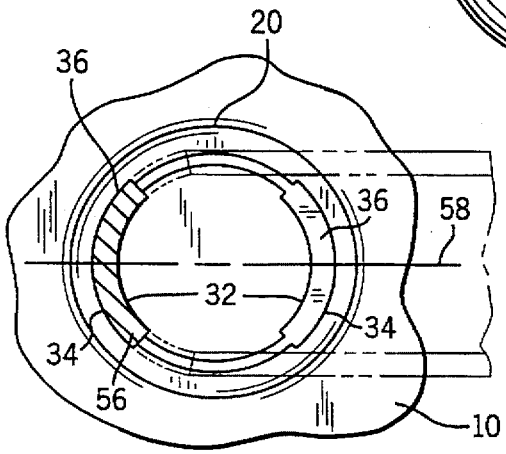
FIG. 9 is a detail view of the socket and bracket shown in FIG. 7 wherein the bracket is shown in section taken along line 9—9 of FIG. 8 to illustrate the manner in which the bracket fits into the socket to secure the finial thereon.

As illustrated in FIGS. 2 and 3, each finial 10 typically includes a decorative portion 19 coupled to and supported by a mounting socket 20. Mounting socket 20 engages tubes 14 and 16 of rod 12, thereby maintaining and supporting finial 10 on the rod ends. Socket 20 is also preferably configured to permit finial 10 to be mounted on a holdback bracket as described below. For mounting finial 10 on tubes 14 and 16 of rod 12, socket 20 includes a first pair of grooves or slots 30, each bounded by interior side walls 22 and exterior side walls 24. Side walls 22 and 24 define first and second engagement surfaces respectively for contacting rod 12. Specifically, as finial 10 is mounted on smaller tube 16 of rod 12, first engagement surfaces 22 enter into and contact the interior of tube 16 to hold the finial in place on the end of tube 16. Similarly, as finial 10 is mounted on larger tube 14, second engagement surfaces 24 at least partially surround and contact the end of tube 14 to hold the finial in place. For mounting finial 10 on a holdback bracket, as shown in FIGS. 7 through 9 and as discussed in greater detail below, socket 20 includes a second pair of grooves or slots 36, each bounded by interior and exterior side walls 32 and 34, respectively. In the preferred embodiment illustrated, the interior side walls 22 of grooves 30 join the interior side walls 32 of slots 36 to form a generally cylindrical plug 26. Similarly, the exterior side walls 24 of grooves 30 join the exterior side walls 34 of slots 36 to define a tubular portion 28 surrounding plug 26, with grooves 30 and slots 36 together forming a generally annular relief therebetween. Moreover, plug portion 26 is supported within tubular portion 28 by a base portion 35. The cross sectional shapes of plug and tubular portions 26, 28 and of grooves and slots 30 and 36 formed therebetween conform to the cross sectional shapes of tubes 14 and 16, such that tubes 14 and 16 can be inserted into the annular relief between plug 26 and tubular section 28 for installation of finial 10.

As best illustrated in FIG. 3, first and second engagement surfaces 22 and 24 are angled slightly with respect to one another and with respect to the central axis 38 of socket 20. In particular, as engagement surfaces 22 and 24 extend from base portion 35, first engagement surface 22 converges toward axis 38 at a predetermined draft angle, whereas second engagement surface 24 diverges from axis 38 at a second predetermined draft angle. Thus, engagement surfaces 22 and 24 may be said to form portions of frustoconical surfaces diverging from one another as they extend from base portion 35. These frustoconical shapes are suitably dimensioned to permit socket 20 initially to slip onto tube 14 or 16 without substantial contact with either tube. As socket 20 is urged further onto either tube, however, the frustoconical shapes of engagement surfaces 22 and 24 engage the tube in an interference fit. Specifically, as socket 20 is pressed onto larger tube 14, surface 24 begins to contact the exterior of tube 14, creating an interference or force fit and exerting sufficient pressure on tube 14 to retain finial 10 on tube 14 before tube 14 contacts base portion 35. Similarly, as socket 20 is pressed onto smaller tube 16, surface 22 begins to contact the interior of tube 16, creating an interference or force fit to retain finial 10 on tube 16. While the draft angles of engagement surface 22 and 24 may differ from one another and may vary, it has been found that a draft angle of approximately 2 degrees with respect to axis 38 allows engagement surfaces 22 and 24 to wedge into and around tubes 16 and 14, respectively, for a secure fit.

Figure 4:
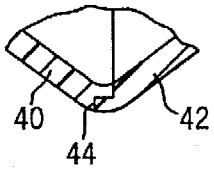
FIG. 4 is a detail view of the finial of FIG. 3, showing a preferred arrangement for joining two halves of the finial for assembly.

Finial 10, including decorative portion 19 and socket 20, may be formed in any suitable manner in a single piece or in multiple pieces designed for subsequent assembly. Moreover, socket 20 may be formed integrally with decorative portion 19 or may be created as a separate insert or subassembly that can be installed or attached to a variety of different decorative portions 19. In the preferred embodiment illustrated in FIGS. 3 and 4, finial 10 is an assembly of two mating shells 40 and 42 each formed separately formed by injection molding, with socket 20 being created integrally with shell 40 in a single operation. Shells 40 and 42 are then joined in a subsequent operation, such as by applying a suitable adhesive along a mating surface 44. Depending upon the ultimate appearance desired, assembled finial 10 may also undergo other subsequent operations such as painting, metallizing and the like.

Figure 5:
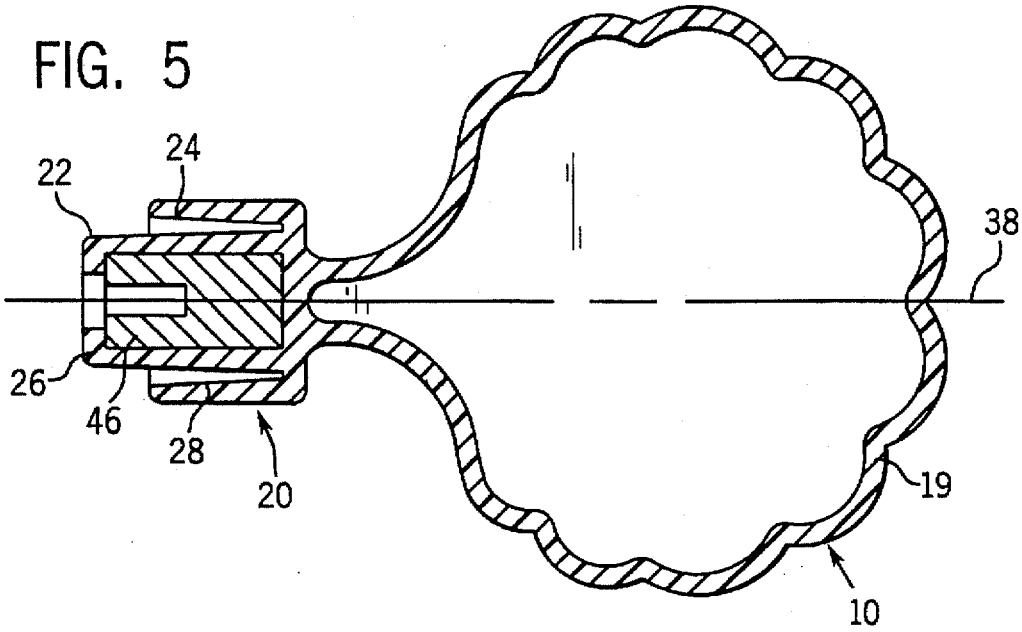
FIG. 5 is a sectional view of another exemplary finial in accordance with the invention, illustrating an alternative preferred embodiment of the socket.
Figure 6:
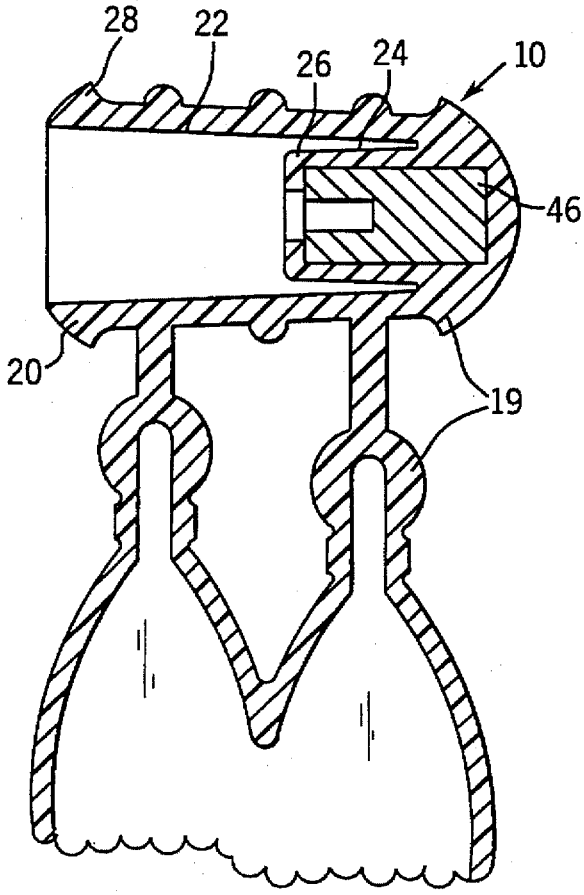
FIG. 6 is a sectional view of a further exemplary finial in accordance with the invention, illustrating another preferred embodiment of the socket.

The structure of socket 20 described above may be adapted to provide additional balance and support to decorative portion 19 as illustrated in FIGS. 5 and 6. In particular, as shown in FIG. 5, for finial designs having a large or outwardly extending decorative portion 19 likely to create a relatively high moment about socket 20, it may be desireable to extend plug portion 26 beyond tubular portion 28. In this configuration, first engagement surface 22 may contact the interior of tubes 14 and 16 to counter the moment created by decorative portion 19. To further aid in balancing decorative portion 19, a metal core or slug 46 may be molded into or inserted into plug portion 26. As illustrated in FIG. 6, for finial designs incorporating a relatively long, depending decorative portion 19 also likely to create a moment about socket 20, second engagement surface 24 may be extended beyond first engagement surface 22. In this configuration, if the moment created by decorative portion 19 is sufficiently high, second engagement surface 24 can contact the exterior of tubes 14 and 16 to prevent finial 10 from tilting under the weight of decorative portion 19. Moreover, a metal core or slug 46 may be provided within plug portion 26 to assist in balancing decorative portion 19.

In addition to being securable on different sized tubes 14, 16, socket 20 is preferably adapted for mounting on a holdback bracket 48 as illustrated in FIGS. 7, 8 and 9. Holdback brackets generally of the type illustrated in the FIGURES are well known in the window coverings art and typically include an attachment flange 50 having mounting holes 52 for attachment to a wall or window frame, such as by screws (not shown). A bent or bowed holdback portion 54 extends from flange 50 to create a space designed to receive and hold a curtain or other window covering. Holdback portion 54 terminates in a mounting portion 56 (shown in section in FIG. 9) in the form of a flat or arcuate tang.

While socket 20 may include a single slot or aperture for receiving mounting portion 56 of holdback bracket 48, it preferably includes a pair of slots 36 arranged in diametrically opposed positions. Moreover, slots 36 are preferably symmetrical about a transverse axis 58 as shown in FIG. 9. In the preferred embodiment illustrated, slots 36 are conveniently formed contiguous with grooves 30 as described above. Slots 36 are suitably dimensioned to engage mounting portion 56 in an interference or force fit as finial 10 is pressed onto holdback bracket 48.

The particular placement and symmetry of slots 36 described above and illustrated in the FIGURES offer several advantages. First, for finials of the type shown in FIG. 1, designed to present a front decorative face with symmetry about transverse axis 58, the finial can be flipped or inverted top-to-bottom (i.e. about transverse axis 58) for installation on a holdback brackets 48 on the left or right side of a window opening. For finials of the type shown in FIG. 6, having similar front and back decorative faces but designed to maintain a given top-to-bottom orientation, the finial can be flipped or inverted side-to-side (i.e. about a vertical axis) for mounting on the left or right side of a window opening. Moreover, molding of socket 20 is simplified by providing slots 36 as a contiguous relief with grooves 30.

While the invention is susceptible to various modifications and alternative forms, specific embodiments have been shown and described by way of example in the foregoing drawings and detailed description. However, it should be understood that the invention is not intended to be limited to the particular forms disclosed. Rather, the invention is intended to cover all modifications, equivalents and alternatives falling within the spirit and scope of the invention as defined by the appended claims.

What is claimed is:

1. A socket for mounting a finial to first or second tubular structures, the first tubular structure having peripheral dimensions smaller than the peripheral dimensions of the second tubular structure, the socket comprising:

a first engagement surface configured to enter into the first tubular structure and to contact at least a portion of the first tubular structure to retain the socket on the first tubular structure, the first engagement surface being tapered in a first direction to wedge into the first tubular structure; and a second engagement surface configured to at least partially surround the second tubular structure and to contact the second tubular structure to retain the socket on the second tubular structure, the second engagement surface being tapered in a second direction opposite to the first direction to wedge over the second tubular structure.

2. The socket of claim 1, wherein the socket includes a central plug having a periphery configured to conform to the periphery of the first tubular structure and wherein the first engagement surface comprises at least a portion of the periphery of the plug.

3. The socket of claim 1, wherein the socket includes an annular groove having inner and outer sides and wherein portions of the inner and outer sides define first and second engagement surfaces respectively.

4. The socket of claim 1, wherein the first and second tubular structures are circular cylindrical and the first and second engagement surfaces are concentric arcuate surfaces.

5. A finial adapted for mounting on a window covering support rod of the type including a first tube and a second tube, the first tube being slidably received in the second tube, the finial comprising:

an end portion for covering an end of the first or the second tube;

a socket portion coupled to the end portion for supporting the finial on the first or the second tube, the socket portion including a first engagement surface configured to enter into the first tube and to contact at least a portion of the first tube to retain the socket on the first tube and a second engagement surface configured to at least partially surround the second tube and to contact the second tube to retain the socket on the second tube, wherein the first engagement surface is tapered in first a direction to engage the first tube in an interference fit and the second engagement surface is tapered in a second direction opposite to the first directions to engage the second tube in an interference fit.

6. The finial of claim 5, wherein the end portion includes a decorative structure extending from the socket portion.

7. The finial of claim 5, wherein the socket portion includes a central plug having a periphery configured to conform to the first tube and wherein the first engagement surface comprises at least a portion of the periphery of the plug.

8. The finial of claim 5, wherein the socket portion includes an annular groove having inner and outer sides and wherein portions of the inner and outer sides define first and second engagement surfaces respectively.

9. The finial of claim 5, wherein the first and second engagement surfaces are concentric arcuate surfaces.

10. The finial of claim 5, wherein the socket portion is formed integrally with the end portion of an injection moldable plastic material.

11. A finial adapted for mounting on a tubular window covering support rod of the type including a first tube slidingly received in a second tube and on a holdback bracket of the type having a holdback portion terminating in a finial mounting portion, the finial comprising:

a decorative portion; and a socket portion coupled to the decorative portion for maintaining the finial on the rod or the bracket, the socket portion including a first engagement surface configured to enter into and engage the first tube, a second engagement surface configured to fit over and engage the second tube and a slot configured to receive the mounting portion of the holdback bracket, wherein the socket includes an annular groove having first and second side walls and the first and second engagement surfaces are defined by at least a portion of the first and second side walls respectively.

12. The finial of claim 11, wherein the slot is part of the annular groove.

13. The finial of claim 11, wherein the slot is an enlarged region in the annular groove configured to engage the mounting portion of the holdback bracket in an interference fit.

* * * * *